United States Patent [19]

Lundgren

[11] 4,343,509

[45] Aug. 10, 1982

[54] PIECE OF SEATING FURNITURE

[75] Inventor: Gillis Lundgren, Lönashult, Sweden

[73] Assignee: Inter-ikea A/S, Humlebaek, Denmark

[21] Appl. No.: 136,729

[22] Filed: Apr. 2, 1980

[30] Foreign Application Priority Data

Apr. 9, 1979 [DK] Denmark ..... 1479/79

[51] Int. Cl.[3] ..... A47C 15/00

[52] U.S. Cl. ..... 297/232; 297/219; 297/440

[58] Field of Search ..... 297/440, 445, 422, 232, 297/218, 219, 257, 459

[56] References Cited

U.S. PATENT DOCUMENTS

| | | | |
|---|---|---|---|
| 2,089,818 | 8/1937 | Terker | 297/440 |
| 2,281,341 | 4/1942 | Turner | 297/445 |
| 2,364,452 | 12/1944 | Kramer | 297/440 |
| 2,618,316 | 11/1952 | Way | 297/440 |
| 3,330,597 | 7/1967 | Lay | 297/445 |
| 3,608,959 | 9/1971 | Sarvas | 297/440 |
| 3,653,712 | 4/1972 | Sarvas | 297/218 |
| 3,870,366 | 3/1975 | Rogers | 297/440 |
| 4,062,589 | 12/1977 | Klein | 297/440 |
| 4,077,517 | 3/1978 | Hilemn | 297/440 |
| 4,114,949 | 9/1978 | Benoit | 297/232 |

FOREIGN PATENT DOCUMENTS

| | | | |
|---|---|---|---|
| 1118414 | 11/1961 | Fed. Rep. of Germany | 297/459 |
| 1345985 | 1/1963 | France | 297/440 |

*Primary Examiner*—Francis K. Zugel

[57] ABSTRACT

A piece of seating furniture, preferably a sofa, comprising a possibly upholstered frame (11) of tubes, some of the tubes (11*e*, 11*f*) curving slightly downwards and functioning as a support for loosely placed, coherent seats and backs (2*a*, 2*b*) freely pivotal about their connecting line.

The piece of seating furniture permits an easy angle adjustment between seat and back and is easy to disassemble and assemble.

7 Claims, 9 Drawing Figures

PIECE OF SEATING FURNITURE

Figure 1:
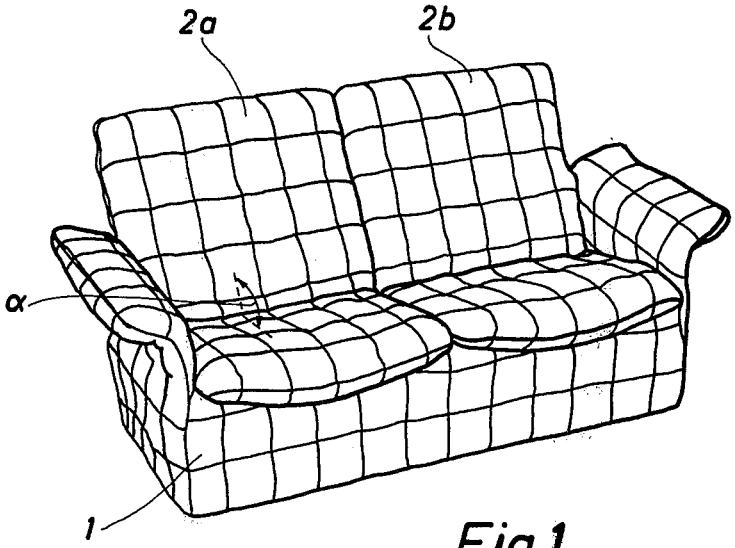

The invention relates to a piece of seating furniture, preferably a sofa, comprising at least one seat portion and at least one back portion.

In seating furniture comprising a seat- and a back portion these portions are normally permanently fastened to an underlying frame portion. In certain cases the seat- and/or back portion may, however, pivot on pins or a fastened shaft in the frame portion, but this involves a rather complicated construction.

It is the object of the present invention to provide a piece of seating furniture of the above stated kind permitting a very easy angle adjustment of seat portion and back portion and further being very easily separable (with a view to easy transportation).

The piece of seating furniture according to the invention is characterized in that it comprises a hollow, at least upwardly open lower part having at least two supporting portions provided with upper, downwardly bent supporting surfaces, and at least one "seat- and back" unit loosely arranged on top of the lower part and resting on the supporting portions, the seat portion and the back portion of said unit being integrally formed and mutually forming a solid angle of about 90°–120°. The seat- and back unit being loose relative to the lower part enables a user to easily adjust the seat to the very angle of inclination which he finds comfortable. The seat portion rests loosely on the front supporting portion, and the back portion rests loosely on the rear supporting portion. The user will furthermore find his seat comfortable because of the slightly curved forms of the seat portion and the back portion, the latter contributing to a reduction of the pressure of the seat portion against the thigh of the user when seated in the piece of furniture. The piece of seating furniture is furthermore easily separable and easy to reassemble, whereby the piece of furniture becomes easy to transport. When disassembled it only take up little space.

The piece of seating furniture shaped as a sofa and having at least two seats may according to the invention comprise at least two individually angle-adjustable seat- and back units. The result is that two persons wanting to sit in the sofa can have a comfortable, individually adjusted seat each.

Moreover, according to the invention the lower part may be a tube frame comprising two side member-forming frame portions, and the supporting portions are a pair of front auxiliary tubes and a pair of rear auxiliary tubes, both pairs of auxiliary tubes being demountably connected to the side member-forming frame portions, whereby the seat-and back unit is optionally also constructed of tubes. The result obtained is partly a very easy demounting and a succeeding mounting of the portions of the lower part, and partly that the lower part and the seat-back unit may be made very light.

According to the invention a preferably H-shaped bracing member constructed of tubes may be provided between the supporting portions. The result obtained is a suitable support, this being of particular interest in sofas comprising two or more seat- and back units.

According to the invention the bracing member may in some places be secured to the supporting portions by means of catching pins, but in other places be screwed to the supporting portions. The result obtained is a particularly easy fastening of the bracing member on the supporting portion.

According to the invention it is most advantageous that the rear supporting portion is higher than the front supporting portion and preferably of a height of about 1.75–2.0 times the height of the front supporting portion.

According to the invention the lower part may be coated with textile by having a circumferential tube of textile applied, said tube being slotted during the application, but after the application the slot is closed by means of one or more closing means, such as hooks, snap fasteners or circumferential zippers. The result obtained is that the lower part can easily be provided with textile and upholstery to give it a finished appearance. The seat- and back unit is textile-coated by being enclosed in bags of said textile.

Furthermore, according to the invention the textile tube may be of quilted fabric, preferably a heavily inflammable or a non-inflammable fabric. The piece of furniture is thus encumbered with a very small fire risk.

Furthermore, according to the invention the frame portions may comprise a separate upholstery, preferably of threads tightened by means of springs, as well as a coating of foam plastics.

Finally, according to the invention the seat portion of the seat- and back unit may on its bottom surface comprise one or more hook members stabilizing said unit without preventing easy adjustment of the angle of the seat portion relative to the horizontal plane. This embodiment has in practice turned out to be a most advantageous one.

Figure 2:
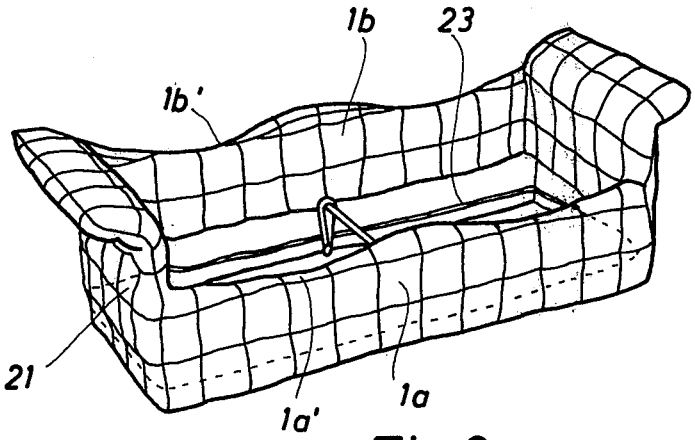

The invention will be described below with reference to the accompanying drawing in which, FIG. 1 is a perspective view of a piece of seating furniture shaped as a two-seat sofa, FIG. 2 is a perspective view of a lower part of the sofa in FIG. 1, the lower part being textile coated, FIG. 3 a perspective view of a lower part of the sofa in FIG. 1, the textile coating being removed, and the tube frame being apparent, FIG. 4 a perspective view of a loose seat- and back unit, FIG. 5 a perspective view of a piece of seating furniture in the form of an armchair, FIG. 6 a perspective view of the lower part of the chair in FIG. 5

Figure 8:
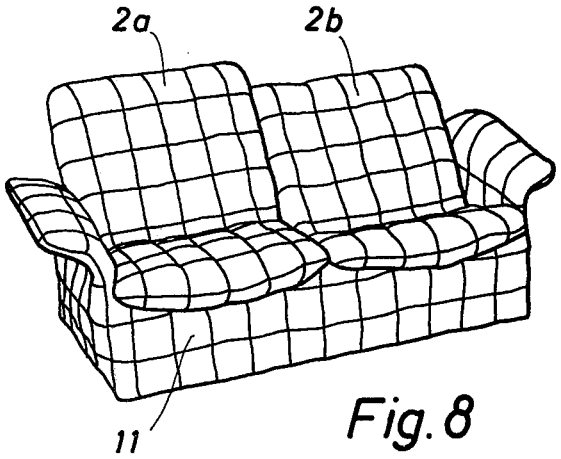
Figure 9:
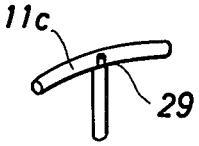
Figure 7:
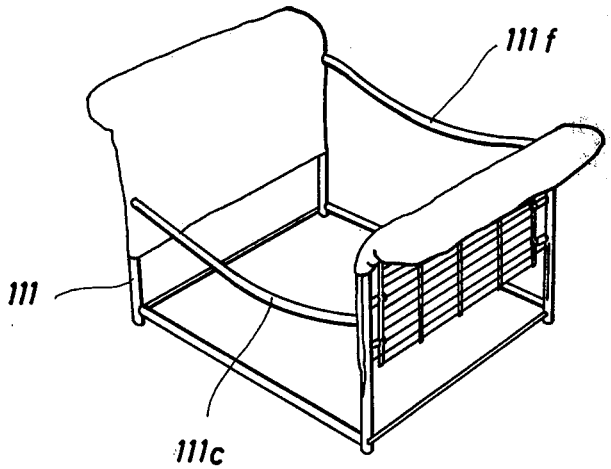
Figure 6:
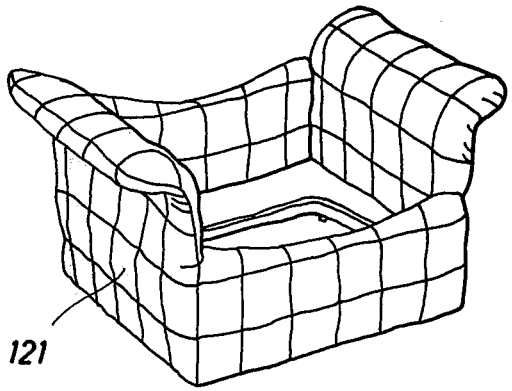

FIG. 7 a perspective view of the lower part shown in FIG. 6 but without the textile coating, FIG. 8 a perspective view of a two-seat sofa corresponding to the one shown in FIG. 1, the two seat- and back units being adjusted to different angle positions, and FIG. 9 a perspective view of the connection between an auxiliary tube and the bracing member.

The sofa shown in FIG. 1 comprises a lower part 1 (cf. also FIG. 2) and two seat- and back units 2*a* and 2*b*. These are loosely arranged on top of the lower part and may as shown in FIG. 8 be arranged in their respective angle positions. The lower part may as shown in FIGS. 2 and 3 also consist of a tube frame 11 and a textile coating 21 mounted on the outside thereof.

As will appear from FIG. 2 the lower part may be hollow and at any rate upwardly open. It comprises a front supporting portion 1*a* and a rear supporting portion 1*b* supporting the seat-and back units, these supporting portions each being provided with downwardly bending supporting surfaces, e.g. 1*a*' and 1*b*', thus making the seat more comfortable, the seat portion and the back portion having a corresponding curvature. This involves that the seat portion will never exert an unpleasant pressure on the underside of the thigh of the user, irrespective of the angle position of the seat- and back unit. Seat portion and back portion form a solid angle $\alpha$ of about 90°–120°. The angle between seat portion and back portion may be adjustable. The mechanism for securing this adjustment may be a construction known per se.

Figure 3:
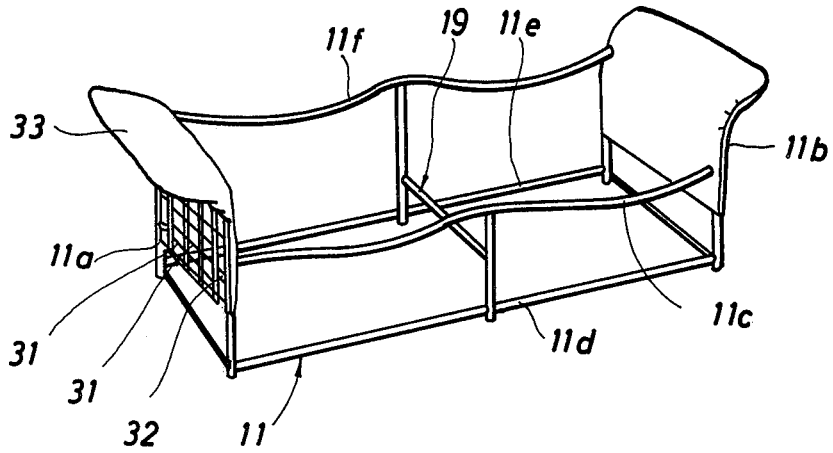

The tube frame 11 of the lower part 1 seen in FIG. 3 comprises two side member frame portions 11*a* and 11*b* and a pair of front auxiliary tubes 11*c* and 11*d* (forming the front supporting portion) and a pair of rear auxiliary tubes 11*e* and 11*f*. The tubes 11*c*, 11*d*, 11*e* and 11*f* are secured to the side member frame portions 11*a* and 11*b* by screwing. An H-shaped bracing member 19, also made of tubes, may be provided in the middle of the tube frame 11 as shown in FIG. 3. This member is preferably screwed to the auxiliary tubes 11*d* and 11*e* but secured to the auxiliary tubes 11*c* and 11*f* by means of catching pins 29 secured to the member, said pins sliding into corresponding openings in the auxiliary tubes 11*c* and 11*f*, cf. FIG. 9. The assembling of the frame parts is hereby facilitated considerably. The auxiliary tube 11*f* will normally be at a level over the floor corresponding to 1.75–2.0 times the level of the auxiliary tube 11*c* over the floor.

As shown in FIG. 2 the lower part 1 is provided with a textile coating by having a circumferential textile tube applied, said tube comprising bulges on the spots where the side member frame portions should be. The textile tube is moreover of a rather compressed cross-section. When the textile tube is to be arranged on the frame, the circumferential closing means, e.g. a circumferential zipper, is open, and when the coating is then pulled down over the frame, the zipper 23 is closed. In FIG. 2 it is most practical to use two zippers, one for the left half of the lower portion and one for the right half of the lower portion. In stead of zippers the closing means may be hooks or snap fasteners.

The textile tube is most conveniently made of quilted fabric, preferably a heavily inflammable fabric. This may e.g. be a chemically treated fabric. The figure clearly shows the quilt (the seams). The sections defined by the seams contain synthetic wadding.

In FIG. 3 is seen how the side member frame portions 11*a* and 11*b*-before the application of the textile tube-has been provided with a separate upholstery, e.g. in the form of parallel threads 31 tightened by means of springs 32 and coated with foam plastics 33. The result is that the side member portions are very soft and comfortable to lean against.

Figure 4:
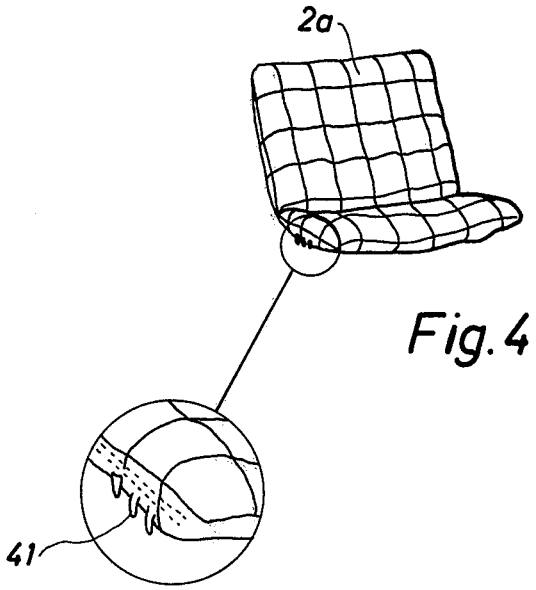

FIG. 4 shows a loose seat- and back unit 2*a*. On the underside thereof a number of hooks 41 may be provided, said hooks extending over the supporting surface 1*a*' on the supporting portion 1*a* to stabilize the seat- and back unit. The hooks do, however, not provide any hinging. It should be possible at any time to lift the seat- and back unit to a new desired angle position.

The closing means may also be burr fasteners in stead of the above mentioned zippers. Such a fastener consists of two tapes abutting on each other, one tape having a number of small projecting loops and the other having a number of small projecting hooks. The hooks and the loops can then cooperate.

Beyond the advantage that the piece of furniture takes up very little room when disassembled, the invention is advantageous because it consists of very few parts.

In FIG. 3 the auxiliary tube 11*c* is an unbroken tube. There is, however, nothing to prevent that it comprises two tube portions, one for each seat. The two tube portions will then be interconnected by means of a coupling part (not shown) opposite the bracing member 19.

The back portion may at the top be provided with a renewable head-rest, which is, however, not shown.

The above quilted fabric may be made very heavily inflammable by being subjected to a special chemical treatment.

Figure 5:
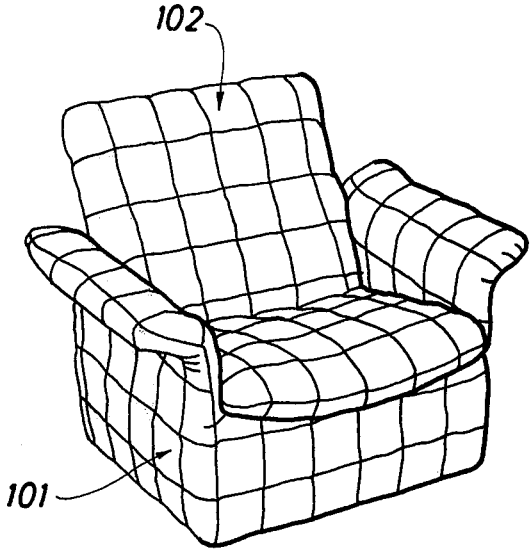

FIG. 5 shows a seating furniture according to the invention in the form of an armchair comprising a hollow, upwardly open lower part 101 and a seat- and back unit 102 arranged loosely hereon. As shown in FIGS. 6 and 7 the lower part may comprise a tube frame 11 and a textile coating mounted on the tube frame in the same way as the textile coating 21 in FIG. 2. However, the armchair in FIG. 7 comprises no bracing member corresponding to the bracing member 19 in FIG. 3. Like the lower part 1 the lower part 101 comprises a front auxiliary tube 111*c* and a rear auxiliary tube 111*f* to support the seat- and back unit 102.

I claim:

1. A piece of seating furniture shaped as a sofa comprising a hollow upwardly open lower part (1) having a tube frame (11) with two side member-forming frame portions (11*a*, 11*b*) and separated front and rear supporting portions (1*a*, 1*b*) respectively provided with upwardly and downwardly curved supporting surfaces (1*a*', 1*b*'), said supporting portions being a pair of front auxiliary tubes (11*c*, 11*d*) and a pair of rear auxiliary tubes (11*e*, 11*f*), both pairs of auxiliary tubes being connected to the side member frame portions, a preferably H-shaped bracing member (19) made of tube provided between the supporting portions (1*a*, 1*b*), and at least two seat and back units (2*a*, 2*b*) loosely arranged on top of the lower part (1) and resting on the supporting portions and being unconnected thereto, said seat-and back units each having a seat portion and a back portion with each of said portions having a substantially planar top surface and a back surface which is slightly curved to have a curvature corresponding to the curvature of said supporting surfaces, said seat and back portions being connected together to form an angle ($\alpha$) of about 90–120 degrees with respect to each other, said angle for said units being seperately adjustable.

2. A piece of seating furniture as claimed in claim 1, wherein the bracing member (19) is secured to the supporting portions by means of catching pins and screws.

3. A piece of seating furniture as claimed in claim 1, wherein the rear supporting portion (1*b*) is higher than the front supporting portion (1*a*) and preferably of a height of about 1.75–2.0 times the height of the front supporting portion.

4. A piece of seating furniture as claimed in claim 1, wherein the lower part (1) is coated with textile by having a circumferential tube of textile (2) applied, said textile tube being slotted during the application, but after the application the slot is closed by means of one or more closing means (23) such as hooks, snap fasteners or circumferential zippers.

5. A piece of seating furniture as claimed in claim 4, wherein the textile tube (21) is made of quilted fabric, preferably a heavily inflammable fabric or a non-inflammable fabric.

6. A piece of seating furniture as claimed in claim 1, wherein the side member frame portions (11*a*, 11*b*)

comprise a separate upholstery, preferably of threads (31), said threads being tightened by means of springs (32), as well as a coating (33) of foam plastics.

7. A piece of seating furniture as claimed in claim 1, where the seat portion of the seat- and back unit (*2a, 2b*) on its underside comprises one or more hook members (41) stabilizing said unit without preventing an easy adjustment of the angle of the seat portion relative to the horizontal plane.

* * * * *